US010626710B1

(12) United States Patent
Romero

(10) Patent No.: US 10,626,710 B1
(45) Date of Patent: Apr. 21, 2020

(54) DOWNHOLE PERISTALTIC PUMP ASSEMBLIES

(71) Applicant: Danny Javier Perez Romero, Houston, TX (US)

(72) Inventor: Danny Javier Perez Romero, Houston, TX (US)

( * ) Notice: Subject to any disclaimer, the term of this patent is extended or adjusted under 35 U.S.C. 154(b) by 0 days.

(21) Appl. No.: 16/255,031

(22) Filed: Jan. 23, 2019

Related U.S. Application Data

(60) Provisional application No. 62/620,612, filed on Jan. 23, 2018.

(51) Int. Cl.

| | |
|---|---|
| ***E21B 43/12*** | (2006.01) |
| ***F04B 43/00*** | (2006.01) |
| ***F04B 43/10*** | (2006.01) |
| ***F04B 43/113*** | (2006.01) |
| ***F04B 43/107*** | (2006.01) |
| ***F04B 43/12*** | (2006.01) |

(52) U.S. Cl.
CPC ..... *E21B 43/129* (2013.01); *E21B 43/121* (2013.01); *F04B 43/0072* (2013.01); *F04B 43/10* (2013.01); *F04B 43/107* (2013.01); *F04B 43/113* (2013.01); *F04B 43/1133* (2013.01); *F04B 43/12* (2013.01)

(58) Field of Classification Search
CPC ..... F04B 43/10; F04B 43/067; F04B 43/107; F04B 43/1133; F04B 47/00; F04B 47/02; F04B 43/0072; F04B 43/113; F04B 43/12; E21B 43/121; E21B 43/129
See application file for complete search history.

(56) References Cited

U.S. PATENT DOCUMENTS

| | | | | | |
|---|---|---|---|---|---|
| 2,196,993 | A * | 4/1940 | Kidder | F04B 47/00 | 417/246 |
| 2,291,912 | A * | 8/1942 | Meyers | F01L 33/02 | 251/5 |
| 2,931,309 | A * | 4/1960 | Bower | F04B 43/113 | 405/53 |
| 3,007,416 | A * | 11/1961 | Childs | A61M 1/1037 | 417/383 |
| 3,039,309 | A * | 6/1962 | Vesper | F04B 43/1133 | 417/394 |
| 3,154,021 | A * | 10/1964 | Vick, Jr. | F04B 43/1133 | 417/394 |
| 3,173,372 | A * | 3/1965 | Baldwin | F04B 43/095 | 417/394 |

(Continued)

FOREIGN PATENT DOCUMENTS

| | | | |
|---|---|---|---|
| DE | 102010003778 | A1 | 10/2011 |
| RU | 2591363 | C1 | 8/2015 |
| RU | 2622217 | C1 | 6/2017 |

*Primary Examiner* — Peter J Bertheaud
(74) *Attorney, Agent, or Firm* — Elliot & Polasek, PLLC; Douglas H. Elliot; Nathan Q. Huynh

(57) ABSTRACT

The disclosure herein includes a peristaltic pump assembly for pumping wellbore fluid, which peristaltic pump assembly may include: a pump; a housing having a chamber; a conduit coupled to the pump and the housing, wherein fluid may be capable of ingress into the conduit from the chamber or egress from the conduit into the chamber; and a hose having a portion disposed in the chamber, wherein the portion may be capable of being compressed by fluid disposed in the chamber.

18 Claims, 11 Drawing Sheets

(56) References Cited

U.S. PATENT DOCUMENTS

| | | | | | |
|---|---|---|---|---|---|
| 3,318,251 | A * | 5/1967 | Smith | F04B 1/00 | 138/30 |
| 3,701,618 | A * | 10/1972 | Wall | B28B 3/20 | 417/474 |
| 4,158,530 | A * | 6/1979 | Bernstein | F04B 43/1133 | 417/389 |
| 4,580,952 | A * | 4/1986 | Eberle | F04B 47/04 | 417/383 |
| 4,886,432 | A * | 12/1989 | Kimberlin | F04B 43/10 | 417/478 |
| 5,273,406 | A * | 12/1993 | Feygin | F04B 43/10 | 417/474 |
| 8,020,624 | B2 | 9/2011 | Ocalan | | |
| 2015/0093257 | A1 | 4/2015 | Lastra | | |

* cited by examiner

FIG. 8

| | | | | | | | | | | | | | | | | | |
|---|---|---|---|---|---|---|---|---|---|---|---|---|---|---|---|---|---|
| | Post-Hose Length: | 0.00 | ft. | | | | | | | | | | | | | | |
| | | **0** | in. | effective hose length being compressed | | | pumping efficiency **100%** | | | pumping efficiency **78.0%** | | | | | | | |
| | Metal Top Length: | 0.33 | ft. | | | | | | | | | | | | | 10 | 2.5 |
| | | **4** | in. | | | | | | | Vol.: | **0.023** | US Oil Barrel | | SPM: | | **6** | 1.25 |
| 31 | Hose #1 Length: | 30.90 | ft. | 30.52 | ft. | Vol.: | **0.17** | $ft^3$ | Vol.: | 0.130 | $ft^3$ | | | | | | |
| 30.5 ft. | | **360** | **370.8** | in. | **366.3** | in. | | 287.7 | $in^3$ | | 224.4 | $in^3$ | | 10 sec/macro-stroke | | | |
| | Metal Top-Middle Length: | 0.50 | ft. | | | | | | | | | | | 2.5 sec/micro-stroke | | | |
| | | **6** | in. | | | | | | | | | | | 1.25 to compress & 1.25 to decompress | | | |
| | | | | | | | | | | | | | | (1 day = 1440 min) | | | |
| 32 | Hose #2 Length: | 31.78 | ft. | 31.40 | ft. | Vol.: | 0.17 | $ft^3$ | Vol.: | 0.13 | $ft^3$ | | | BPD: | | **200** | |
| 31.4 ft. | | 366.3 | **381.4** | in. | **376.8** | in. | | 295.9 | $in^3$ | | 230.8 | $in^3$ | | | | | |
| | Metal Middle Length: | 0.50 | ft. | | | | | | | | | | | | | | |
| | | **6** | in. | | | | | | | | | | | | | | |
| 33 | Hose #3 Length: | 32.66 | ft. | 32.28 | ft. | Vol.: | 0.18 | $ft^3$ | Vol.: | 0.14 | $ft^3$ | | | | | | |
| 32.3 ft. | | 376.8 | **391.9** | in. | **387.4** | in. | | 304.2 | $in^3$ | | 237.3 | $in^3$ | | | | | |
| | Metal Middle-Bottom Length: | 0.50 | ft. | | | | | | | | | | | | | | |
| | | **6** | in. | | | | | | | | | | | | | | |
| 34 | Hose #4 Length: | 33.54 | ft. | 33.16 | ft. | Vol.: | 0.18 | $ft^3$ | Vol.: | 0.14 | $ft^3$ | | | | | | |
| 33.2 ft. | | 387.4 | **402.5** | in. | **397.9** | in. | | 312.5 | $in^3$ | | 243.8 | $in^3$ | | | | | |
| | Metal Bottom Length: | 0.33 | ft. | | | | | | | | | | | | | | |
| | | **4** | in. | | | | | | | | | | | | | | |
| | Pre-Hose Length: | 0.00 | ft. | | | | | | | | | | | | | | |
| | | **0** | in. | | | | | | | | | | | | | | |
| | Fitting Length: | 4.27 | in. | | | | | | | | | | | | | | |
| | Fitting Cut-Off: | 1.99 | in. | | | | | | | | | | | | | | |
| | pg. 152 | 2.28 | | | | | | | | | | | | | | | |

FIG. 9

| | | | | | | | | | | | | | | |
|---|---|---|---|---|---|---|---|---|---|---|---|---|---|---|
| | Post-Hose Length: | 0.00 | ft. | | | | | | | | | | | |
| | | **0** | in. | effective hose length being compressed | | pumping efficiency **100%** | | | pumping efficiency **78.1%** | | | | | |
| | Metal Top Length: | 0.33 | ft. | | | | | | | | | | 4 | 1 |
| | | **4** | in. | | | | | | Vol.: | **0.023** | US Oil Barrel | SPM: | **15** | 0.5 |
| 31 | Hose #1 Length: | 30.90 | ft. | 30.52 | ft. | Vol.: | **0.17** | $ft^3$ | Vol.: | 0.130 | $ft^3$ | 4 sec/macro-stroke | | |
| 30.5 ft. | | **360** | **370.8** | **366.3** | in. | | 287.7 | $in^3$ | | 224.7 | $in^3$ | 1 sec/micro-stroke | | |
| | Metal Top-Middle Length: | 0.50 | ft. | | | | | | | | | 0.5 to compress & 0.5 to decompress | | |
| | | **6** | in. | | | | | | | | | (1 day = 1440 min) | | |
| 32 | Hose #2 Length: | 31.78 | ft. | 31.40 | ft. | Vol.: | 0.17 | $ft^3$ | Vol.: | 0.13 | $ft^3$ | BPD: | **500** | |
| 31.4 ft. | | 366.3 | **381.4** | **376.8** | in. | | 295.9 | $in^3$ | | 231.1 | $in^3$ | | | |
| | Metal Middle Length: | 0.50 | ft. | | | | | | | | | | | |
| | | **6** | in. | | | | | | | | | | | |
| 33 | Hose #3 Length: | 32.66 | ft. | 32.28 | ft. | Vol.: | 0.18 | $ft^3$ | Vol.: | 0.14 | $ft^3$ | | | |
| 32.3 ft. | | 376.8 | **391.9** | **387.4** | in. | | 304.2 | $in^3$ | | 237.6 | $in^3$ | | | |
| | Metal Middle-Bottom Length: | 0.50 | ft. | | | | | | | | | | | |
| | | **6** | in. | | | | | | | | | | | |
| 34 | Hose #4 Length: | 33.54 | ft. | 33.16 | ft. | Vol.: | 0.18 | $ft^3$ | Vol.: | 0.14 | $ft^3$ | | | |
| 33.2 ft. | | 387.4 | **402.5** | **397.9** | in. | | 312.5 | $in^3$ | | 244.1 | $in^3$ | | | |
| | Metal Bottom Length: | 0.33 | ft. | | | | | | | | | | | |
| | | **4** | in. | | | | | | | | | | | |
| | Pre-Hose Length: | 0.00 | ft. | | | | | | | | | | | |
| | | **0** | in. | | | | | | | | | | | |
| | Fitting Length: | 4.27 | in. | | | | | | | | | | | |
| | Fitting Cut-Off: | 1.99 | in. | | | | | | | | | | | |
| | pg. 152 | 2.28 | | | | | | | | | | | | |

DOWNHOLE PERISTALTIC PUMP ASSEMBLIES

RELATED APPLICATIONS

This application claims priority to provisional application No. 62/620,612 filed on Jan. 23, 2018, and hereby incorporates the provisional application No. 62/620,612 by reference as if set forth in its entirety.

FIELD OF INVENTIONS

1. Field of Inventions

The field of this application and any resulting patent is downhole peristaltic pump assemblies.

2. Description of Related Art

Various downhole peristaltic pump assemblies and methods for pumping downhole fluid have been proposed and utilized, including some of the methods and structures disclosed in some of the references appearing on the face of this application. However, those methods and structures lack the combination of steps and/or features of the methods and/or structures disclosed herein. Furthermore, it is contemplated that the methods and/or structures disclosed herein solve many of the problems that prior art methods and structures have failed to solve. Also, the methods and/or structures disclosed herein have benefits that would be surprising and unexpected to a hypothetical person of ordinary skill with knowledge of the prior art existing as of the filing date of this application.

SUMMARY

The disclosure herein includes a peristaltic pump assembly for pumping wellbore fluid, which peristaltic pump assembly may include: a peristaltic pump assembly for pumping wellbore fluid, comprising: a pump; a housing having a chamber; a conduit coupled to the pump and the housing, wherein fluid may be capable of ingress into the conduit from the chamber or egress from the conduit into the chamber; and a hose having a portion disposed in the chamber, wherein the portion may be capable of being compressed by fluid disposed in the chamber.

The disclosure herein includes a peristaltic pump assembly for pumping wellbore fluid, which peristaltic pump assembly may include: a peristaltic pump assembly for pumping wellbore fluid, comprising: a pump; a housing having a chamber; a conduit coupled to the pump and the housing, wherein fluid may be capable of ingress into the conduit from the chamber or egress from the conduit into the chamber; a hose having a portion disposed in the chamber, wherein the portion has a collapsible section and a support.

The disclosure herein includes a peristaltic pump assembly for pumping wellbore fluid, which peristaltic pump assembly may include: a peristaltic pump assembly for pumping wellbore fluid, comprising: a pump; a housing; a first chamber disposed in the housing; a second chamber disposed in the housing; a hose having a first portion disposed in the first chamber and a second portion disposed in the second chamber; a first conduit coupled to the pump and the housing, the first conduit in fluid communication with first chamber; and a second conduit coupled to the pump and the housing, the second conduit in fluid communication with the second chamber.

The disclosure herein includes a peristaltic pump assembly for pumping wellbore fluid, which peristaltic pump assembly may include: a pump; a housing having a chamber; a conduit coupled to the pump and the housing, wherein fluid flowing in the conduit is capable of being received in the chamber; a hose having a portion disposed in the chamber; and a piston disposed in the chamber, wherein the piston is capable of being abutted against the hose.

The disclosure herein includes a method of pumping fluid, which method may include: pumping fluid into a first chamber of a downhole peristaltic pump; collapsing a first portion of a hose disposed in the first chamber; extracting fluid from a second chamber of the downhole peristaltic pump; expanding a second portion of a hose disposed in the second chamber; and pushing fluid within the first portion of the host into the second portion of the hose.

The disclosure herein includes a method of pumping fluid, which method may include: pumping fluid into a first chamber of a downhole peristaltic pump; collapsing, with the fluid, a first portion of a hose disposed in the first chamber; extracting fluid from a second chamber of the downhole peristaltic pump; restoring to its original shape a second portion of a hose disposed in the second chamber; and pushing fluid within the first portion of the host into the second portion of the hose.

BRIEF DESCRIPTION OF THE DRAWINGS

FIG. 8 illustrates a chart including dimensions of various hoses in peristaltic pump assemblies operating at 6 rpm and corresponding downhole fluid production metrics.

FIG. 9 illustrates a chart including dimensions of various hoses in peristaltic pump assemblies operating at 15 rpm and corresponding downhole fluid production metrics.

DETAILED DESCRIPTION

1. Introduction

Figure 1:
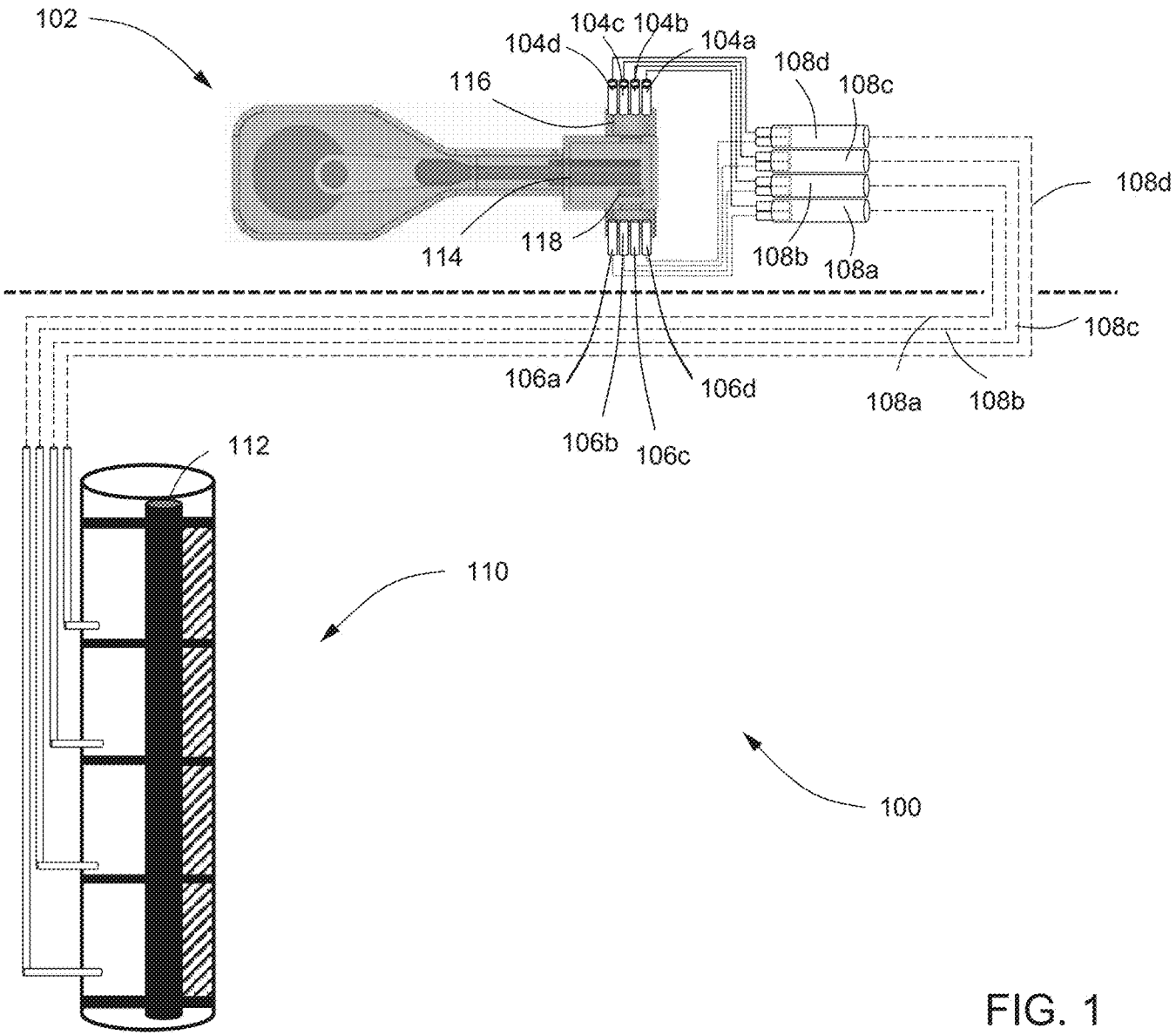
FIG. 1 illustrates a cross-sectional side view of a peristaltic pump assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "abut against" as used herein is defined as position adjacent and either physically touching or pressing against, directly or indirectly. After any abutting takes place, the objects may be fully or partially "abutted." For example, a first object may be abutted against a second object such that the second object is limited from moving in a direction of the first object. For example, a hose may be abutted against a support.

The term "adjacent" as used herein is defined as next to and may include physical contact but does not require physical contact. For example, a hose may be adjacent a support. Also, a support may be adjacent a housing.

The term "align" as used herein is a verb that means manufacture, form, adjust, or arrange one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure. For example, an aperture may be an opening that begins on one side of the solid object and ends on the other side of the object. An aperture may alternatively be an opening that does not pass entirely through the object, but only partially passes through, e.g., as a groove. An aperture can be an opening in an object that is completely circumscribed, defined, or delimited by the object itself. Alternatively, an aperture can be an opening in the object when the object is combined with one or more other objects or structures. One or more apertures may be disposed and passed entirely through wall, washer, and/or spacer. An aperture may receive another object, e.g. coupler or hose. An aperture may provide for ingress and/or egress of fluid, e.g., hydrocarbon, oil, and/or water, through the aperture.

The term "assembly" as used herein is defined as any set of components that have been fully or partially assembled together. A group of assemblies may be coupled to form an assembly or a solid housing having an inner surface and an outer surface.

The term "chamber" as used herein is defined as an enclosure, e.g., in a solid object or structure. A chamber may have the shape of a cylinder. A chamber may have a cylindrical wall and a wall coupled to an inner surface of the cylindrical wall. A chamber may have fluid disposed therein. A chamber may have a hose and/or a support disposed therein. A chamber may have a hose, a support, and/or a piston disposed therein.

The term "collapse" as used herein is a verb that means deform, e.g., yield or cave-in, under pressure. After any collapsing takes place, the objects may be fully or partially "collapsed." A structure having an original internal space, e.g., annulus, would have a new smaller internal space after being collapsed. A structure or an object having a portion that is capable of being collapsed, e.g., by pressure from fluid or another structure, is said to be collapsible.

The term "compress" as used herein is a verb that means apply force e.g., towards and/or against an object or structure, directly or indirectly. Compressing may compel, e.g., urge, cause, influence, force, and/or press, displacement and/or deformation of an object; however, the object may or may not be displaced and/or deformed. After any compressing takes place, the objects may be fully or partially "compressed." A first object or structure compressing a second object may transfer force to the second object. A first object or structure compressing a second object may cause the second object to push a third object, directly or indirectly. For example, a first volume of fluid compressing a hose may cause an inner surface of the hose to push, directly or indirectly, against second volume of fluid in the hose. A first object directly compressing a second object may physically touch the second object. A first object indirectly compressing a second object may physically touch a medium that physically touches the second object. The medium may be a structure, e.g., washer, spacer, or seal. A fluid may indirectly compress a hose by pushing against a piston that is abutted against the hose.

The term "conduit" as used herein is defined as structure configured to convey fluid therethrough. A conduit may have a through-bore. A conduit may be coupled to a pump. A conduit may be coupled to a pump and a hydraulic conduit. A conduit may be in fluid communication with a hydraulic conduit. For example, fluid may be transferred between an inflation or a deflation conduit and a hydraulic conduit. A conduit may be coupled to a peristaltic pump. A conduit may be in fluid communication with a peristaltic pump.

The term "coupled" as used herein is defined as directly or indirectly connected, attached, or unitary, e.g., part of. A first object may be coupled to a second object such that the first object is positioned at a specific location and orientation with respect to the second object. A first object may be permanently, removably, threadably, or fluidically coupled to a second object. Two objects may be permanently coupled to each other via a coupling device, adhesive, welding, or mechanically pressed together; or they may be removably coupled via nails, screws, or nuts and bolts. Thus, ends of two hoses may be coupled by a coupler. Also, two objects may be removably coupled to each other via shear pins, threads, tape, latches, hooks, fasteners, locks, male and female connectors, clips, clamps, knots, and/or surface-to-surface contact. For example, a conduit and a pump may be removably coupled to each other such that the conduit may then be uncoupled and removed from the pump. In addition, two objects may be capable of being threadably coupled together, e.g., where a threaded outer surface of one object is capable of being engaged with or to a threaded inner surface of another object. Also, two objects may be fluidically coupled to each other, via one or more couplers, tape, glue, and/or welding, such that fluid may flow between the objects. For example, a first portion and a second portion of a hose may be fluidically coupled downhole such that fluid may flow from the first portion to the second portion.

The term "coupler" as used herein is defined as a structure configured for coupling two hoses or hose portions. A coupler may extend through a chamber. A coupler may extend through a wall of a chamber. A coupler may be cylindrical.

The term "cylindrical" as used herein is defined as shaped like a cylinder, e.g., the shape of a structure having straight parallel sides and a circular or oval or elliptical cross-section. A cylindrical body or structure, e.g., chassis, may be completely or partially shaped like a cylinder. A housing, a hose, a conduit, or a support are examples of cylindrical bodies. A cylindrical object may have an aperture that is extended through the entire length of the object to form a hollow cylinder capable of permitting another object or fluid to be extended or passed through. Alternatively, a solid cylindrical object may have an inner surface or outer surface having a diameter that changes abruptly. A cylindrical object may have and inner or outer surface having a diameter that changes abruptly to form a collar, e.g., flange, radial face, rim, or lip. A cylindrical object may have a collar extending toward or away from the central axis of the object. A cylindrical object may have a collar disposed on an inner surface. A cylindrical object may have a collar disposed on an outer surface. Additionally, a cylindrical object, may have a collar that is tapered or radiused.

The term "elastic" as used herein is an adjective defined as able to spontaneously resume a previous shape after compression or collapse, e.g., deformation, contraction, dilatation, and/or distortion. For example, an elastic hose collapsed by fluid or a piston pressed against the hose would spontaneously resume a cylindrical shape after the fluid or the piston is removed.

The term "exemplary" is used exclusively herein to mean "serving as an example, instance, or illustration." Anything, including any embodiment, structure, element, or step, described herein as exemplary, is not to be construed as preferred or advantageous over other embodiments, structures, elements, steps, etc.

The terms "first" and "second" as used herein merely differentiate two or more things or actions, and do not signify anything else, including order of importance, sequence, etc.

The term "flow path" as used herein is defined as a conduit or space through which fluid is capable of flowing. A flow path may be disposed within an object, e.g., peristaltic pump, chamber, hose, and/or conduit. A flow path may extend uninterrupted through ends of an object, e.g., peristaltic pump, chamber, hose, hydraulic conduit, and/or fluid line. A flow path may be formed by a groove disposed on an object. A flow path may be a groove disposed in an outer surface of an object. A flow path may be formed by the inner surface of an object. A flow path may be formed by the inner surface of a group of coupled objects, e.g., peristaltic pump, chamber, hose, coupler, hydraulic conduit, and/or fluid line. A flow path may be formed from two or more connected flow paths.

The term "flow rate" as used herein is defined as the volume of fluid that passes per unit of time. Volume may be measured in gallons or liters. Time may be measured in seconds, minutes, or hours. For example, a flow rate of a pumped fluid may be measured anywhere, e.g., at the surface or a point within a wellbore. A flow rate of a pumped fluid may be measured before the fluid is pumped into a chamber of peristaltic pump. A flow rate of a pumped fluid may be measured at a station or a pump that pumped the fluid.

The term "fluid" as used herein is defined as material that is capable of flowing. A fluid may be a liquid or a gas. Examples of a fluid may include air, hydrocarbon, water, drilling fluid, drilling mud, cement, lubricant, cleaning fluid, and motor oil. A fluid may include material, e.g., hydrocarbon, water, compounds, and/or elements originating from underground rock formation. A fluid can be a mixture of two or more fluids. A fluid may absorb heat. A fluid may have properties such as viscosity, anti-foaming, thermal stability, thermal conductivity, and thermal capacity. Fluid in a downhole tubular string used in driving a pump or a motor may be call "mud." A fluid may be water-based, oil-based, synthetic, or a combination of viscous materials and solid materials.

The term "fluid port" as used herein is defined as an aperture in a structure sized and configured to provide ingress and/or egress of fluid therethrough. A fluid port may be an inlet port. A fluid port may be an outlet port. A fluid port may be disposed in a surface pump, a peristaltic pump, and/or a tubular. A fluid port may extend through a housing. A fluid port may extend in a direction perpendicular to the central axis of a tubular. Fluid ports may be disposed symmetrically around a tubular. In some cases, fluid ports may not necessarily be precisely the same circumferential distance apart. The preferable circumferential distance between each fluid port in a tubular may be approximately 360 degrees divided by the number of fluid ports.

The term "hose" as used herein is defined as a flexible conduit. A hose may be compressible. A hose may be collapsible. A hose may be resilient, e.g., able to return to a cylindrical shape after being collapsed. Multiple hoses may be coupled to form a longer hose. A hose may have a collapsible portion and a support portion. A hose may have a collapsible portion and a support portion that are unitary.

The term "housing" as used herein is defined as a structure, preferably a cylindrical structure, capable of being filled with fluid, e.g., hydrocarbon, water, drilling fluid, cement, lubricant, and/or cleaning fluid. A housing may have a central cylindrical aperture extending therethrough with an opening on either side. A housing may have one or more threaded ends for coupling with another housing. Multiple housings may be coupled axially to form a longer housing. A housing may receive another object or structure therein. A housing and an object or structured disposed therein may be concentric.

The term "motor" as used herein is defined as an assembly for driving movement, of an object, e.g., wheel, plunger, piston, and/or drive shaft, or more generally for driving the operation of a pump. Movement of an object may include rotation of the object on a central axis. Additionally, movement may include longitudinal displacement of an object, e.g., plunger, relative to another object, e.g., housing. A motor may include a drive shaft assembly capable of being coupled to a pump, e.g. surface pump.

The term "orthogonal" as used herein is defined as at an angle ranging from 85° or 88 to 92° or 95°. Two structures that are orthogonal to each other may be perpendicular and/or tangential to each other.

The term "peristalsis" as used herein is defined as alternating contraction, e.g., collapse, of one portion and relaxation, e.g., resumption of a cylindrical shape, of another portion of an object or structure. For example, peristalsis may be imparted to a hose in which a first elastic portion of the hose is collapsed, e.g., by fluid pressure or a piston, and a second elastic portion of the hose resumes a cylindrical shape after pressure decrease and/or removal.

The term "piston" as used herein is defined as a structure configured to be moved by fluid pressure, e.g. to be abutted against a hose. A piston may receive fluid pressure against a surface of the piston. A piston may have a head. A piston may be moved, e.g., slid, relative to a housing. A piston may be slid in chamber.

The term "pressure" as used herein is defined as force per unit area. Pressure may be exerted against a surface of an object, e.g., hose, conduit, piston, or plunger, from the flow of fluid across the surface. Liquid pressure in a hose, for example, can be created by the liquid exerting force against the inner wall(s) of the hose.

The term "provide" as used herein is a verb defined as make available, furnish, supply, equip, or cause to be placed in position.

The term "pump" as used herein is defined as an assembly configured to drive movement of fluid. Movement of an object may include rotation of the object on a central axis. A "surface pump" may be a rotating drive pump capable of driving and/or retracting one or more fluid columns. A surface pump may include a plunger, e.g., drive shaft, capable of being reciprocated longitudinally. A surface pump may be located above ground. A "peristaltic pump" may be any pump capable of imparting peristalsis to portions of an elastic structure or object, e.g. a hose. A peristaltic pump may be disposed in a wellbore.

The term "push" as used as a verb herein is defined as apply force e.g., towards and/or against an object or structure, directly or indirectly. Pushing may compel, e.g., urge, cause, influence, force, and/or press, displacement of an object; however, the object may or may not be displaced. A first object pushing a second object may transfer force to the second object. For example, hydraulic fluid pushing against a portion of a hose may transfer force to the portion. A first object pushing a second object may cause the second object to push a third object, directly or indirectly. For example, fluid pushing against a piston may cause the piston to push against a portion of a hose, directly or indirectly. A first object directly pushing a second object may physically touch the second object. A first object indirectly pushing a second object may physically touch a medium that physically touches the second object. The medium may be a structure, e.g., piston, washer, spacer, or seal.

The term "support" as used herein is defined as a structure configured to support, e.g. prop up or keep rigid, a portion of a hose. A support and a hose may be unitary. A support may be coupled to a portion of a hose. A support and a hose may be concentric. A support may be parallel with a hose. A portion of a hose may be collapsed towards a support.

The term "surface" as used herein is defined as any face of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a housing, hose, coupler, and/or hydraulic conduit. A surface may have irregular contours. A surface may be formed from coupled components, e.g., housing, wall, coupler, piston, hose, and/or hydraulic conduits. Coupled components may form irregular surfaces. A plurality of surfaces may be connected to form a polygonal cross-section. An example of a polygonal cross-section may be triangular, square, rectangular, pentagonal, hexagonal, or octagonal. Socket surfaces may have socket surfaces connected to form a polygonal shape, e.g., triangular, square, rectangular, pentagonal, hexagonal, or octagonal. Socket surfaces may have curved walls connected to form a substantially polygonal shape, e.g., triangular, square, rectangular, pentagonal, hexagonal, or octagonal.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a housing, a hose, housing, and/or sleeve, and a tubular. Threads formed on an inner surface of an object may be referred to as "box threads". Threads formed on an outer surface of an object, e.g., housing, sleeve, conduit, or tubular, may be referred to as "pin threads." A threaded assembly may include a "threaded portion" wherein a section of the threaded assembly includes threads, e.g., pin threads or box threads. A threaded portion may have a diameter sized to extend through an aperture of a sleeve, a housing, or a collar. In certain cases, a threaded portion of a first object may be removably coupled to a threaded portion of a second object.

The term "tubular" as used herein is defined as a structure having an inner surface and an outer surface. A tubular may have an aperture disposed therethrough. Preferably, a tubular is cylindrical. Examples of a tubular may include a housing, hose, conduit, and/or sleeve. However, any or all tubulars of an assembly may have polygonal cross-sections, e.g., triangular, rectangular, pentagonal, hexagonal, or octagonal.

The term "unitary" as used herein is defined as having the nature, properties, or characteristics of a single unit. For example, a hose and a support that are individual parts may be unitary in the sense they are not separate but rather are formed from a single piece of material, e.g., rubber, silicone, plastic, carbon fiber, ceramic, or metal. Additionally, a piston head and a piston stem that are individual parts of a piston may be unitary in the sense they are not separate but rather are formed from a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a pump, a motor, a housing, a sleeve, a hose, a support and/or a chamber may each have an upper end and a lower end. Additionally, a cylindrical object, e.g., housing, hose, conduit, housing, and/or sleeve may have an upper portion and a lower portion. The term "top" as used herein means in the highest position, e.g., farthest from the ground. The term "bottom" as used herein means in the lowest position, e.g., closest the ground. For example, a cylindrical object, e.g., housing, hose, motor, housing, and/or sleeve, may have a top portion and a bottom portion.

The term "wall" as used herein is defined as a structure configured to define a chamber in a peristaltic pump. A wall may be flat. A wall may have a disc, circular, and/or cylindrical shape. A wall may have an aperture disposed therethrough.

3. Certain Specific Embodiments

The disclosure herein includes a peristaltic pump assembly for pumping wellbore fluid, which peristaltic pump assembly may include: a peristaltic pump assembly for pumping wellbore fluid, comprising: a pump; a housing having a chamber; a conduit coupled to the pump and the housing, wherein fluid may be capable of ingress into the conduit from the chamber or egress from the conduit into the chamber; and a hose having a portion disposed in the chamber, wherein the portion may be capable of being compressed by fluid disposed in the chamber.

The disclosure herein includes a peristaltic pump assembly for pumping wellbore fluid, which peristaltic pump assembly may include: a peristaltic pump assembly for pumping wellbore fluid, comprising: a pump; a housing having a chamber; a conduit coupled to the pump and the housing, wherein fluid may be capable of ingress into the conduit from the chamber or egress from the conduit into the chamber; a hose having a portion disposed in the chamber, wherein the portion has a collapsible section and a support.

The disclosure herein includes a peristaltic pump assembly for pumping wellbore fluid, which peristaltic pump assembly may include: a peristaltic pump assembly for pumping wellbore fluid, comprising: a pump; a housing; a first chamber disposed in the housing; a second chamber disposed in the housing; a hose having a first portion disposed in the first chamber and a second portion disposed in the second chamber; a first conduit coupled to the pump and the housing, the first conduit in fluid communication with first chamber; and a second conduit coupled to the pump and the housing, the second conduit in fluid communication with the second chamber.

The disclosure herein includes a peristaltic pump assembly for pumping wellbore fluid, which peristaltic pump assembly may include: a pump; a housing having a chamber; a conduit coupled to the pump and the housing, wherein fluid flowing in the conduit is capable of being received in the chamber; a hose having a portion disposed in the chamber; and a piston disposed in the chamber, wherein the piston is capable of being abutted against the hose.

The disclosure herein includes a method of pumping fluid, which method may include: pumping fluid into a first chamber of a downhole peristaltic pump; collapsing a first portion of a hose disposed in the first chamber; extracting fluid from a second chamber of the downhole peristaltic pump; expanding a second portion of a hose disposed in the second chamber; and pushing fluid within the first portion of the host into the second portion of the hose.

The disclosure herein includes a method of pumping fluid, which method may include: pumping fluid into a first chamber of a downhole peristaltic pump; collapsing, with the fluid, a first portion of a hose disposed in the first chamber; extracting fluid from a second chamber of the downhole peristaltic pump; restoring to its original shape a second portion of a hose disposed in the second chamber; and pushing fluid within the first portion of the host into the second portion of the hose.

Any one of the methods or structures disclosed herein may further include an inlet aperture disposed in the housing for providing ingress of fluid into the chamber.

Any one of the methods or structures disclosed herein may further include an outlet aperture disposed in the housing for providing egress of fluid from the chamber.

In any one of the methods or structures disclosed herein, the fluid is capable of ingress into or egress from the chamber.

Any one of the methods or structures disclosed herein may further include an aperture disposed in the housing for providing ingress of the fluid into the chamber.

Any one of the methods or structures disclosed herein may further include an aperture disposed in the housing for providing egress of the fluid from the chamber.

In any one of the methods or structures disclosed herein, the chamber comprises: two walls, each wall of the two walls having an aperture extending therethrough; and a coupler extending through the aperture of each wall and coupled to each end of the portion of the hose.

In any one of the methods or structures disclosed herein, the hose may be elastic.

In any one of the methods or structures disclosed herein, the hose is compressible.

In any one of the methods or structures disclosed herein, the hose is collapsible.

In any one of the methods or structures disclosed herein, the hose has an elastic portion and rigid support.

Any one of the methods or structures disclosed herein may further include a support disposed in the housing and abutted against the portion of the hose.

In any one of the methods or structures disclosed herein, the collapsible section and the support may be unitary.

In any one of the methods or structures disclosed herein, the support may be abutted against the housing.

In any one of the methods or structures disclosed herein, the fluid may be capable of flowing through the collapsible section and the support.

In any one of the methods or structures disclosed herein, the collapsible section may be elastic.

In any one of the methods or structures disclosed herein, fluid may be capable of ingress into the first chamber from the first conduit or egress from the first chamber into the first conduit, or both.

In any one of the methods or structures disclosed herein, the fluid may be capable of ingress into the second chamber from the second conduit or egress from the second chamber into the second conduit, or both.

Any one of the methods or structures disclosed herein may further include a wall separating the first chamber from the second chamber.

Any one of the methods or structures disclosed herein may further include a coupler disposed between the first chamber and the second chamber.

Any one of the methods or structures disclosed herein may further include a coupler coupled to the first portion of the hose and the second portion of the hose.

In any one of the methods or structures disclosed herein, collapse of the first portion of the hose may push fluid from the first portion of the hose into the second portion of the hose.

In any one of the methods or structures disclosed herein, the first portion of the hose may be collapsible by fluid flowing from the first conduit.

In any one of the methods or structures disclosed herein, the second portion of the hose may be collapsible by fluid flowing from the second conduit.

In any one of the methods or structures disclosed herein, the piston may be capable of being pushed by fluid pressure.

In any one of the methods or structures disclosed herein, the piston may be capable of being pushed by the chamber.

In any one of the methods or structures disclosed herein, the piston may be capable of collapsing the portion of the hose.

Any one of the methods or structures disclosed herein may further include a coupler disposed between first chamber and second chamber.

In any one of the methods or structures disclosed herein may further include a coupler for coupling the first hose to the second hose.

In any one of the methods or structures disclosed herein may further include a wall that separates the first chamber from second chamber.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of downhole peristaltic pump assemblies shown in the drawings, which relate to assemblies, elements, and parts that can be part of a downhole peristaltic pump assembly, and methods for operating (using) such downhole peristaltic pump assemblies. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventor that variations and equivalents of the invention are within the scope of the claims, while the description, abstract and drawings are not to be used to limit the scope of the invention. The invention is specifically intended to be as broad as the claims below and their equivalents.

Described herein are downhole peristaltic pump assemblies and methods for moving downhole fluid. The downhole peristaltic pump assemblies may generate peristaltic waves to move fluid in a wellbore towards the earth's surface. Alternatively, the downhole peristaltic pump assemblies may generate peristaltic waves to move fluid down a wellbore away from the earth's surface. The peristaltic waves may be a radially symmetrical contraction and relaxation of a compressible hose that propagates in an anterograde direction.

FIG. 1 illustrates a cross-sectional side view of a peristaltic pump assembly 100. The peristaltic pump assembly 100 may include a surface pump 102, inflation conduits 104*a-d*, deflation conduits 106*a-d*, hydraulic conduits 108*a-d*, and a peristaltic pump 110. The surface pump 102 may include a motor (not shown), plungers 114, inflation valves 116, and deflation valves 118. The motor may be coupled to the one or more plungers 114. The plunger 114 may be coupled to the inflation valve 116 and the deflation valve 118.

Although only one plunger 114, one inflation valve 116, and one deflation valve 118 is visible in FIG. 1, it should be understood that a surface pump 102 may employ multiple plungers 114, inflation valves 116, and deflation valves 118. One plunger 114 may be coupled to one inflation valve 116 and one deflation valve 118.

Accordingly, one inflation valve 116 may be coupled to one inflation conduit 104. Thus, each of the inflation conduits 104*a-d* may be coupled to one inflation valve 116. Similarly, each of the deflation conduits 106*a-d* may be coupled to one deflation valve 118.

In addition, one inflation conduit 104 and one deflation conduit 106 may be coupled to one hydraulic conduit 108. For example, the inflation conduit 104*a* and the deflation conduit 106*a* may be coupled to the hydraulic conduit 108*a*. Accordingly, the inflation conduits 104*a-d* and the deflation conduits 106*a-d* may be coupled to the hydraulic conduits 108*a-d*, respectively.

Furthermore, fluid may be disposed in the surface pump 102, the inflation conduits 104*a-d*, the deflation conduits 106*a-d*, and the hydraulic conduits 108*a-d*. The fluid disposed in a corresponding inflation conduit 104, deflation conduit 106, and the hydraulic conduit 108 may be referred to as a fluid column. In other words, the inflation conduit 104, the deflation conduit 106, and the hydraulic conduit 108 are fluidically coupled.

The hydraulic conduits 108*a-d* may be couple to a peristaltic pump 110. A fluid column in each hydraulic conduit 108 may be capable of ingress into and/or egress from the peristaltic pump 110. Each fluid column may compress and/or collapse a portion of a hose 112 disposed through the peristaltic pump 110.

The hose 112 may be formed from a plurality of hoses coupled together, e.g., via couplers (not shown). The hose 112 may be coupled to a downhole tubular string (not shown) through which fluid, e.g., hydrocarbon, water, and/or gas, may flow. Fluid may flow through the hose 112 towards a pump (not shown), e.g., line pump or sump pump, that draws the fluid to the earth's surface.

In some versions, hydraulic conduits 108 may be connected to a single-acting quadruplex surface pump 102 at surface, with each cylinder of the surface pump 102 directly connected to a specific hydraulic conduit 108 to pump fluid to/from its correspondent chamber 210. That way, surface equipment may include the surface pump 102, its prime mover, e.g., electric motor, and a cooling system to dissipate the heat from the bottom of the well that is transferred to the pressurized fluid in every stroke imparted by the pump.

Although only one peristaltic pump 110 is shown in FIG. 1, it should be understood that a plurality of peristaltic pumps may be coupled together to form a pump string. Alternatively, a plurality of peristaltic pumps may be coupled to different portions of a downhole tubular string.

Collars may be used to couple the peristaltic pumps to each other or to the downhole tubular string.

Figure 2A:
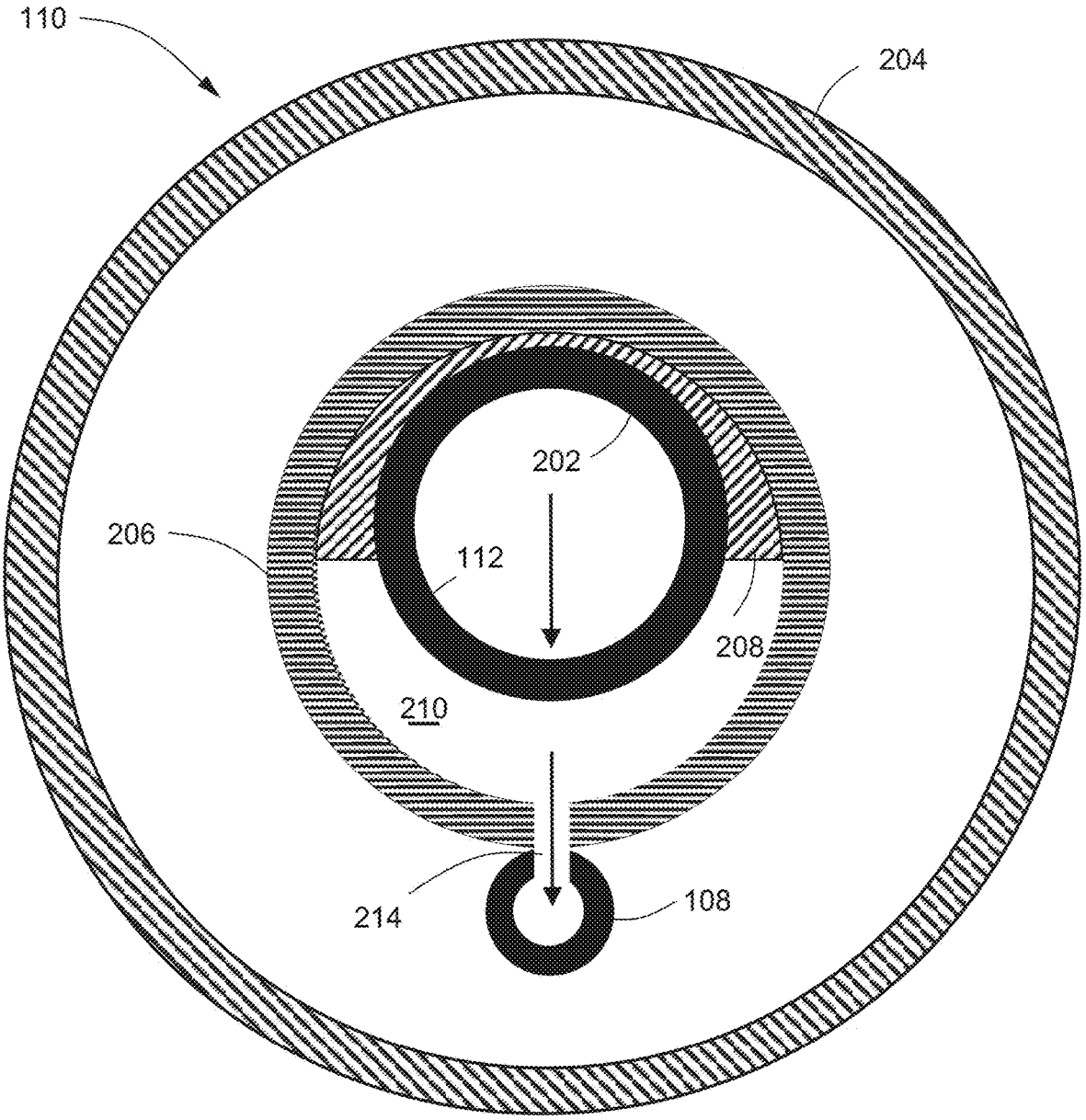
FIG. 2A illustrates a cross-sectional top view of a peristaltic pump assembly having a hose in an uncompressed state.

FIG. 2A illustrates a cross-sectional top view of a peristaltic pump 110 including a portion 202 of a hose 112 in an uncompressed state. The peristaltic pump 110 may be lowered into a well after completion of the well. The peristaltic pump 110 is shown in a vertical position, e.g., upright, which means that it may be operated in a vertical well. However, it should be understood that the peristaltic pump 110 may also be operated in off-vertical or horizontal wells.

The peristaltic pump 110 may include a housing 206, a support 208, and the portion 202 of the hose 112. The portion 202 may be abutted against the support 208. The support 208 and the portion 202 may be concentric. In some versions, the support 208 and the portion 202 of the hose 112 may be unitary.

The support 208 and the portion 202 of the hose 112 may be disposed in the housing 206. Specifically, the support 208 and the portion 202 may be disposed in a chamber 210 of the housing 206. The chamber 210 may be formed by the housing 206 and two walls 402 (FIGS. 4-7) disposed in the housing 206. The two walls 402 may be parallel. The support 208 and the portion 202 may be disposed in a between the walls 402.

Moreover, the housing 206 may be configured for coupling with a hydraulic conduit 108. The hydraulic conduit 108 may be in fluid communication with a fluid port 214. The fluid port 214 may extend through the housing 206. The fluid port 214 may be in fluid communication with the chamber 210. Thus, the hydraulic conduit 108 may be fluidically coupled to the housing 206.

On an upstroke of a plunger 114 (FIG. 1), the plunger 114 would cause a fluid column to be pulled from the chamber 210 into the hydraulic conduit 108. On a downstroke of the plunger 114, the plunger 114 would cause a fluid column to be pushed into the chamber 210 from the hydraulic conduit 108.

Arrows pointing away from the chamber 210 indicate that fluid column is being withdrawn from the chamber 210 through a fluid port 214 into the hydraulic conduit 108. Thus, in some cases, no or insufficient fluid pressure may be applied against the portion 202 of the hose 112. Accordingly, the portion 202 may be uncompressed and/or uncollapsed, e.g., cylindrical. In other cases, fluid pressure may be applied but the fluid pressure may be less than the pressured required to collapse the hose 112. An uncollapsed portion 202 may receive downhole fluid therein.

Figure 2B:
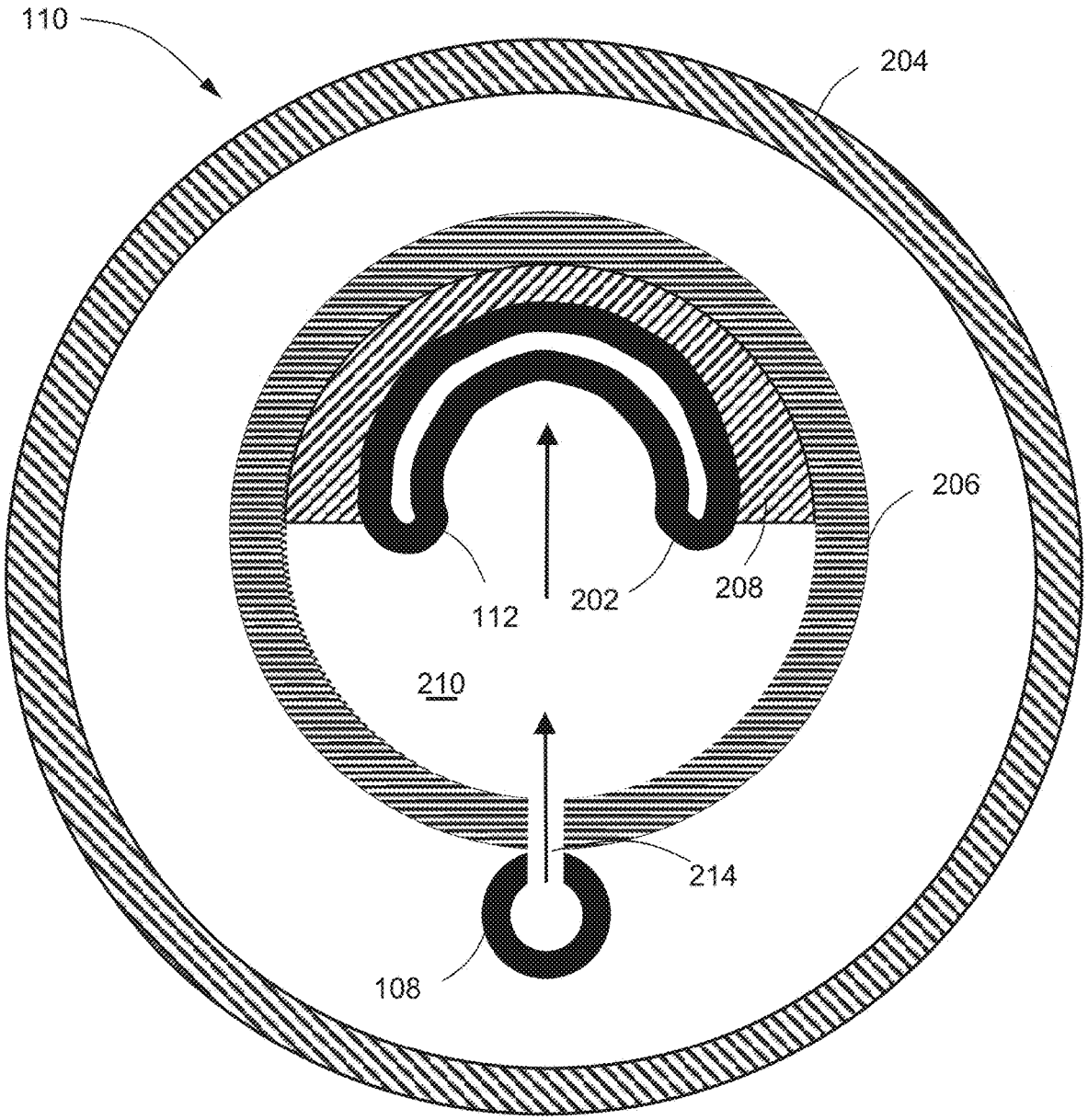
FIG. 2B illustrates a cross-sectional top view of a peristaltic pump assembly having a hose in a compressed state.

FIG. 2B illustrates a cross-sectional top view of a peristaltic pump 110 including a portion 202 of a hose 112 in a compressed state. On a downstroke of the plunger 114, the plunger 114 would cause a fluid column to be pushed into the chamber 210 through hydraulic conduit 108.

Arrows pointing towards a chamber 210 from the hydraulic conduit 108 indicate that fluid column may be pushed through a fluid port 214 into the chamber 210. Thus, fluid pressure may be applied against the portion 202 of the hose 112. In some cases, the fluid pressure may cause the portion 202 to collapse. Collapse of the portion 202 may force a volume of fluid in the portion 202 to be pushed out and/or up from the portion 202.

Figure 3A:
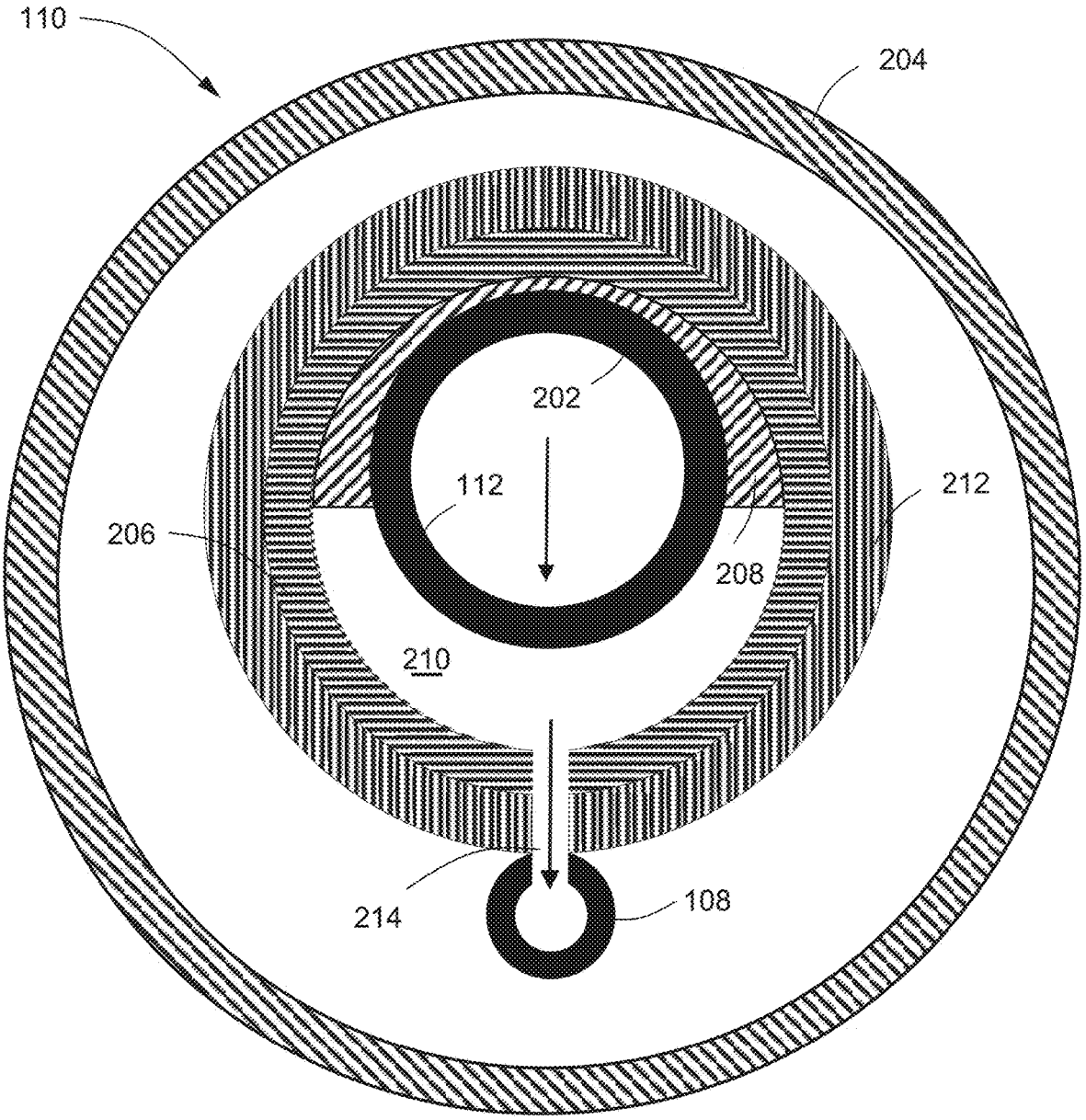
FIG. 3A illustrates a cross-sectional top view of a peristaltic pump assembly having a hose in an uncompressed state and disposed within a collar.

FIG. 3A illustrates a cross-sectional top view of a peristaltic pump 110 including a portion 202 of a hose 112 in an uncompressed state and a collar 212 disposed around a portion of the peristaltic pump 110. The collar 212 and a housing 206 of the peristaltic pump 110 may be concentric. Accordingly, the collar 212 may be coupled to an outer surface of the housing 206, e.g. via press fit, latches, locks, and/or pins. The collar 212 may be disposed around a chamber 210 in the housing 206. The collar 212 may be configured to reinforce and/or protect the peristaltic pump 110.

Moreover, the collar 212 may be configured for coupling with a hydraulic conduit 108. The hydraulic conduit 108 may be in fluid communication with a fluid port 214. The fluid port 214 may extend through the collar 212 and the housing 206. The fluid port 214 may be in fluid communication with the chamber 210. Thus, the hydraulic conduit 108 may be fluidically coupled to the housing 206 through the collar 212.

Arrows pointing away from the chamber 210 indicate that fluid column is being withdrawn from the chamber 210 through a fluid port 214 into the hydraulic conduit 108. Thus, in some cases, no or insufficient fluid pressure may be applied against the portion 202 of the hose 112. Accordingly, the portion 202 may be uncompressed and/or uncollapsed, e.g., cylindrical. In other cases, fluid pressure may be applied but the fluid pressure may be less than the pressured required to collapse the hose 112. An uncollapsed portion 202 may receive downhole fluid therein.

Figure 3B:
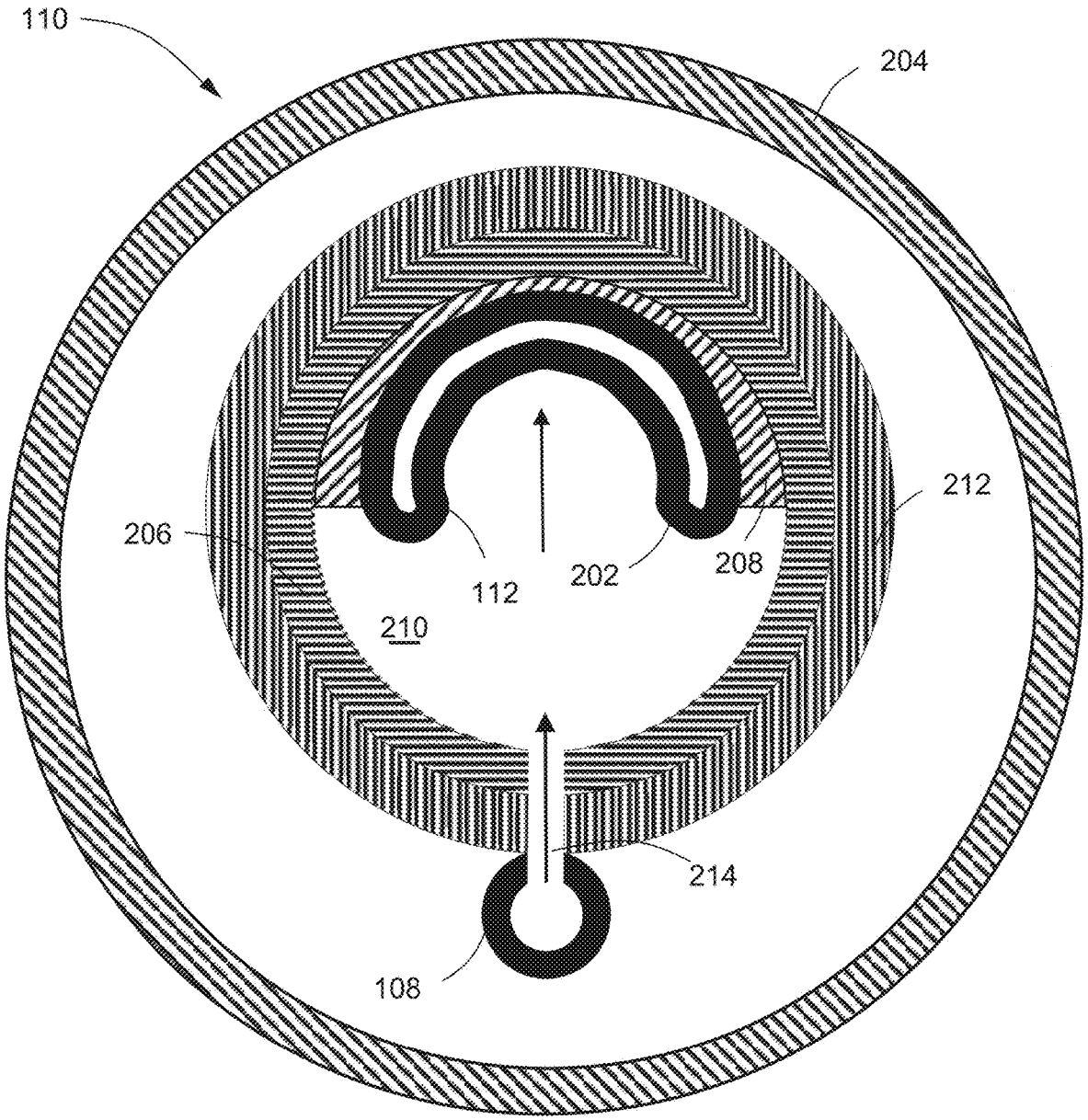
FIG. 3B illustrates a cross-sectional top view of a peristaltic pump assembly having a hose in a compressed state and disposed within a collar.

FIG. 3B illustrates a cross-sectional top view of a peristaltic pump 110 including a portion 202 of a hose 112 in a compressed state and a collar 212 disposed around a portion of the peristaltic pump 110. On a downstroke of the plunger 114, the plunger 114 would cause a fluid column to be pushed into a chamber 210 through hydraulic conduit 108.

Arrows pointing towards the chamber 210 from the hydraulic conduit 108 indicate that fluid column may be pushed through fluid a fluid port 214 into the chamber 210. Thus, fluid pressure may be applied against the portion 202 of the hose 112. In some cases, the fluid pressure may cause the portion 202 to collapse. Collapse of the portion 202 may force a volume of fluid in the portion 202 to be pushed out and/or up from the portion 202.

Referring to FIGS. 4-7, a peristaltic pump 110 may include a housing 206, walls 402*a-e*, a hose 112, and supports 208*a-d*. Chambers 210*a-d* may be disposed in the housing 206 of the peristaltic pump assembly 100. Each chamber 210 may be defined by a portion of the housing 206 and two of the walls 402*a-e*. For example, the chamber 210*a* may be defined by a portion of the housing 206 and the walls 402*a*, 402*b*. An aperture (not shown) may be disposed through the walls 402*a*, 402*b*. Accordingly, a coupler (not shown) may be extended through each aperture of the walls 402*a-e*.

The hose 112 may have portions 202*a-d* disposed in chambers 210*a-d*, respectively. Each portion 202 of the hose 112 may have an upper end and a lower end. Each end of each portion 202 may be coupled to a coupler (not shown). Accordingly, two portions 202 of the hose 112 may be coupled to a coupler. For example, the portion 202*a* in the chamber 210*a* may be coupled, e.g., by a coupler, to a portion 202*b* in chamber 210*b*. Thus, downhole fluid may be communicated between the portions 202*a-d* of the hose 112 towards the surface.

The supports 208*a-d* may be disposed in the chambers 210*a-d*, respectively. The supports 208*a-d* may be disposed adjacent the portions 202*a-d* of the hose 112, respectively. Moreover, the portions 202*a-d* may be abutted against the respective supports 208*a-d*.

Fluid may be disposed in hydraulic conduit 108*a-d* and corresponding chambers 210*a-d*. In each hydraulic conduit 108 and corresponding chamber 210, fluid may form a fluid column. Preferably, each fluid column may be communicated through each hydraulic conduit 108 between the surface pump 102 (FIG. 1) and the peristaltic pump 110.

As shown by an arrow pointing from a hydraulic conduit 108 towards a respective portion 202 of the hose 112, a fluid column may be capable of ingress into chamber 210 from a respective hydraulic conduit 108. Ingress of fluid into the chamber 210 may increase fluid pressure in the chamber 210. An increase in fluid pressure in the chamber 210 may cause the portion 202 of the hose 112 collapse.

Conversely, as shown by an arrow pointing from a portion 202 of the hose 112 towards a respective hydraulic conduit 108, a fluid column may be capable of egress from a chamber 210 into a respective hydraulic conduit 108. Egress of fluid from the chamber 210 may reduce fluid pressure in the chamber 210. A decrease in fluid pressure in the chamber 210 may cause the portion 202 of the hose 112 elastically return to its cylindrical shape.

Figure 4:
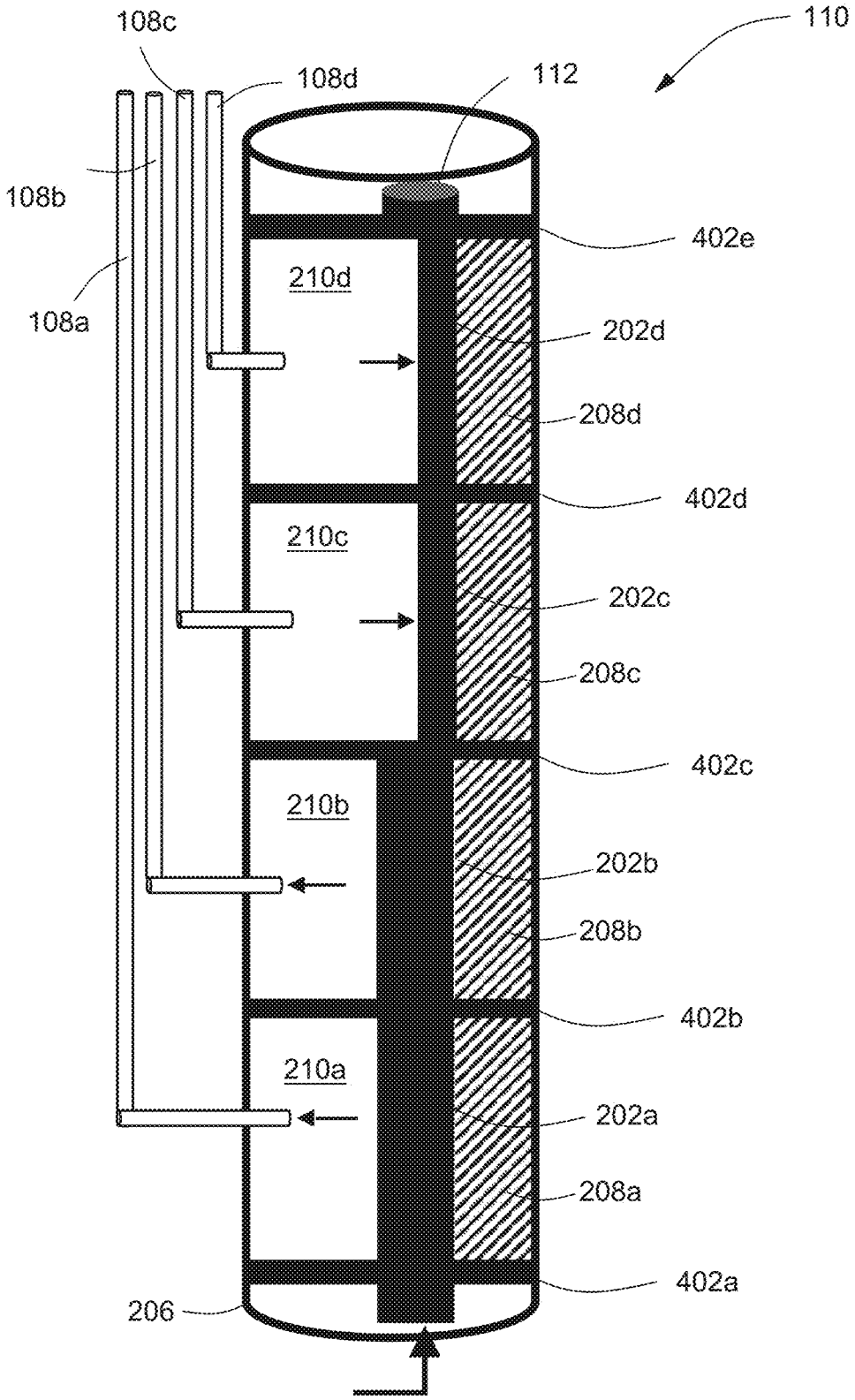
FIG. 4 illustrates a cross-sectional side view of a peristaltic pump assembly in a first pumping configuration.

FIG. 4 illustrates a cross-sectional side view of a peristaltic pump assembly 100 in a first pumping configuration. In the first pumping configuration, hydraulic fluid may be withdrawn from chambers 210*a-b*. Less fluid in the chambers 210*a-b* may cause a decrease in pressure in the chambers 210*a-b*. Decreased pressure in the chambers 210*a-b* may cause portions 202*a-b* of the hose 112 to be uncompressed. The uncompressed portions 202*a-b* may receive downhole fluid.

Conversely, hydraulic fluid may be pumped into chambers 210*c-d*. More fluid in the chambers 210*c-d* may cause an increase in pressure in the chambers 210*c-d*. Increased pressure in the chambers 210*c-d* may compress and/or collapse the portions 202*c-d*, respectively. Thus, downhole fluid may be restricted from communication between the portion 202*b* and the portion 202*c* of the hose 112.

Figure 5:
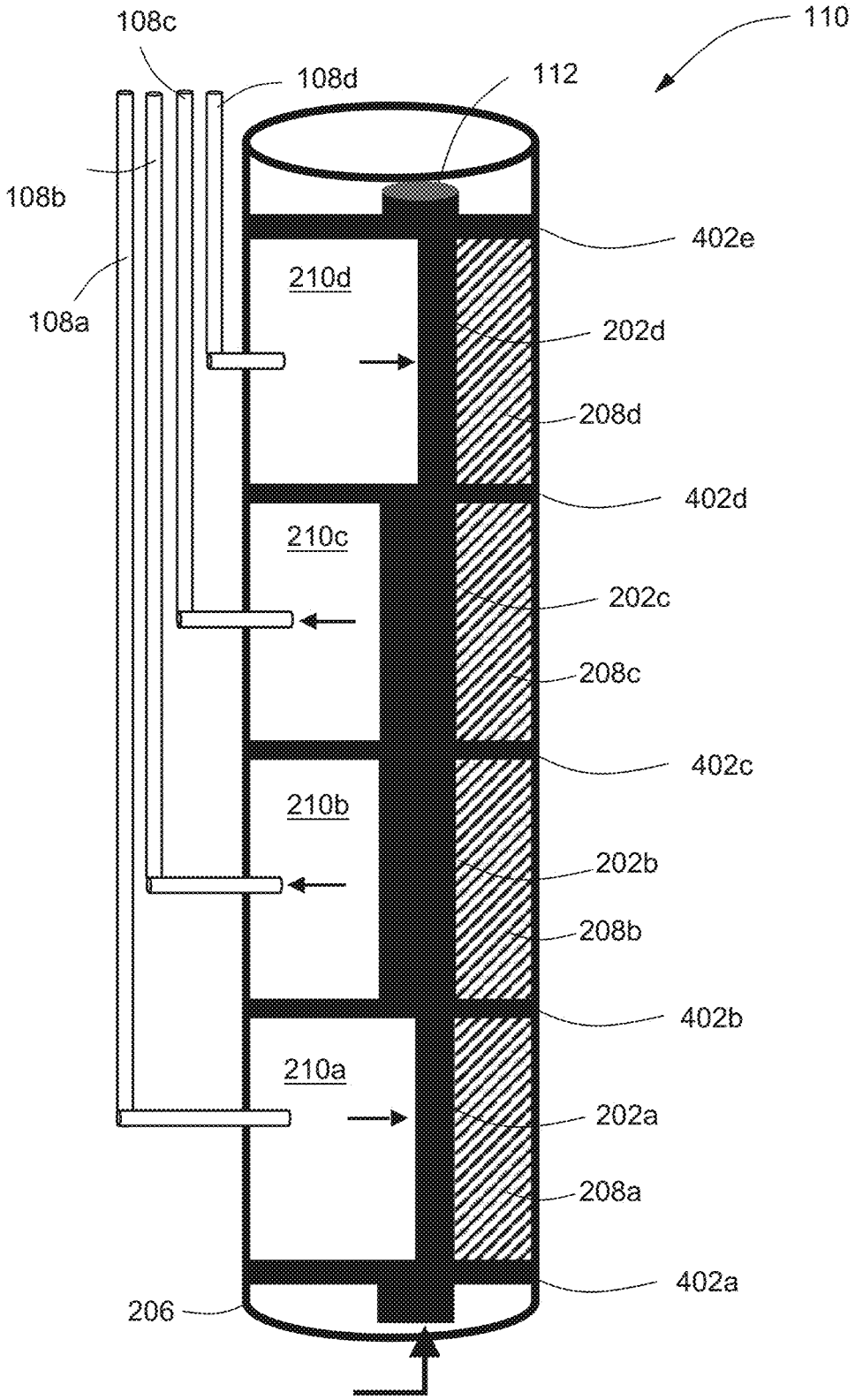
FIG. 5 illustrates a cross-sectional side view of a peristaltic pump assembly in a second pumping configuration.

FIG. 5 illustrates a cross-sectional side view of a peristaltic pump assembly 100 in a second pumping configuration. In the second pumping configuration, hydraulic fluid may be withdrawn from a chamber 210*c*. Less fluid in the chamber 210*c* may cause a decrease in pressure in the chamber 210*c*. Decreased pressure in the chamber 210*c* may cause portion 202*c* of the hose 112 to be uncompressed. The uncompressed portions 202*c* may receive downhole fluid from the portion 202*b*.

Additionally, hydraulic fluid may be pumped into a chamber 210*a*. More fluid in the chamber 210*a* may cause an increase in pressure in the chamber 210*a*. Increased pressure in the chamber 210*a* may compress and/or collapse the portion 202*a*. Compression of the portion 202*a* of the hose 112 may push downhole fluid from the portion 202*a* into the portion 202*b*.

Figure 6:
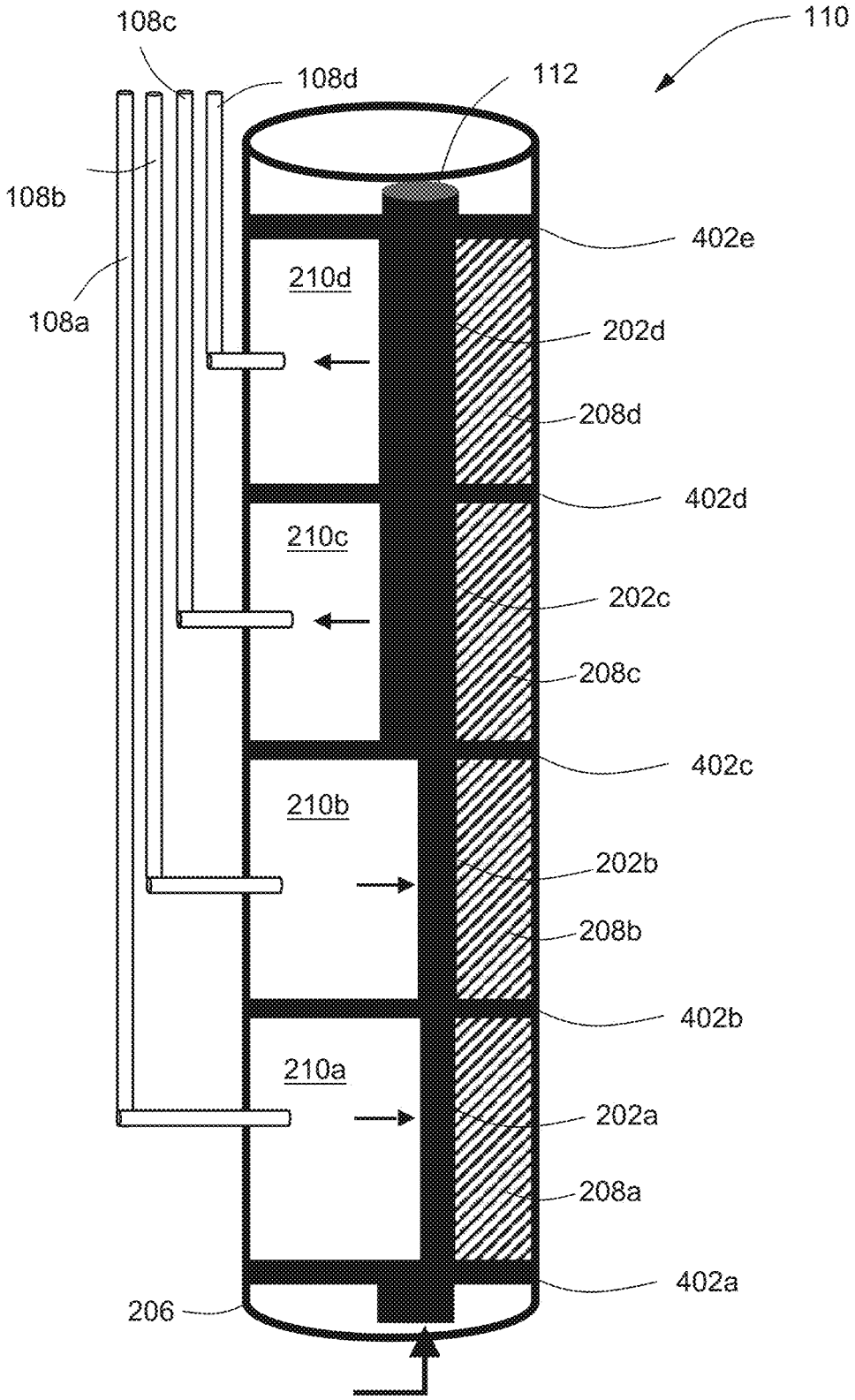
FIG. 6 illustrates a cross-sectional side view of a peristaltic pump assembly in a third pumping configuration.

FIG. 6 illustrates a cross-sectional side view of a peristaltic pump assembly 100 in a third pumping configuration. In the third pumping configuration, hydraulic fluid may be withdrawn from a chamber 210*d*. Less fluid in the chamber 210*d* may cause a decrease in pressure in the chamber 210*d*. Decreased pressure in the chamber 210*d* may cause portion 202*d* of the hose 112 to be relaxed, e.g., uncompressed, to receive downhole fluid, e.g., hydrocarbon, from a portion 202*c* of the hose 112.

Conversely, hydraulic fluid may be pumped into a chamber 210*b*. Increased pressure in the chamber 210*b* may compress and/or collapse the portion 202*b*. Compression of the portion 202*b* may push downhole fluid from the portion 202*b* into the portion 202*c*.

Figure 7:
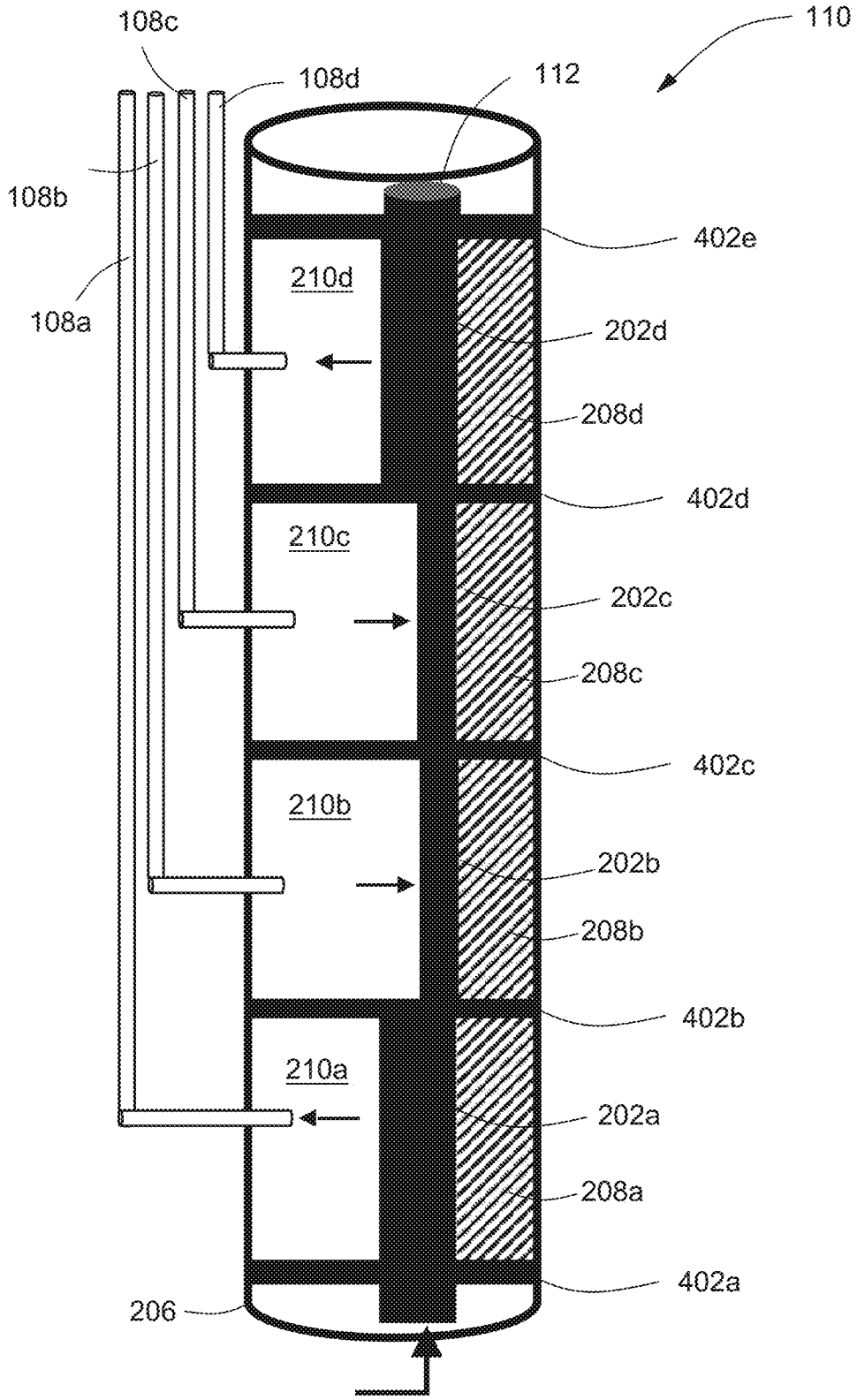
FIG. 7 illustrates a cross-sectional side view of a peristaltic pump assembly in a fourth pumping configuration.

FIG. 7 illustrates a cross-sectional side view of a peristaltic pump assembly 100 in a fourth pumping configuration. In a fourth stage pumping configuration, hydraulic fluid may be withdrawn from a chamber 210*a*. Less fluid in the chamber 210*a* may cause a decrease in pressure in the chamber 210*a*. Decreased pressure in the chamber 210*a* may cause portion 202*a* of the hose 112 to be uncompressed. The uncompressed portion 202*a* may receive downhole fluid from a lower portion (not shown) of the hose 112.

Conversely, hydraulic fluid may be pumped into a chamber 210*c*. More fluid in the chamber 210*c* may cause an increase in pressure in the chamber 210*c*. Increased pressure in the chamber 210*c* may compress and/or collapse the portion 202*c*. Compression of the portion 202*c* may push downhole fluid from the portion 202*c* into the portion 202*d*.

In operation, an operator may configure the surface pump 102 to cause hydraulic fluid in each hydraulic conduit 108 to be repeatedly pumped into and then withdrawn from a chamber 210. Stroking a plunger 114 (FIG. 1) on a downstroke may cause fluid, e.g., liquid or air, to be pushed into a chamber 210. Stroking the plunger 114 on an upstroke may cause fluid to be pulled out from chamber 210.

Thus, by stroking plungers 114 to create the four pumping configurations of FIGS. 4-7, may generate pumping action in a peristaltic pump 110. The pumping action in the peristaltic pump 110 may collapse one or more portions of a hose 112 and relax one or more other portions of the hose 112. Thus, the pumping action in the peristaltic pump 110 may cause propagation of downhole fluid up the peristaltic pump 110. Although the above pump configurations are described individually with reference to FIGS. 4-7 and certain "pumping configurations," it is understood that the pumping configurations may be combined and repeated.

FIG. 8 illustrates a chart including dimensions of various hoses in peristaltic pump assemblies operating at 6 rpm and corresponding downhole fluid production metrics. Peristaltic pump assemblies having four chambers operating with a quadruplex surface pumps are preferable. The minimum four chamber peristaltic pump would produce 200 barrels of downhole fluid per day (B/D) if the peristaltic pump works at 6 rpm (revolutions per minutes) or spm (strokes per minute).

FIG. 9 illustrates a chart including dimensions of various hoses in peristaltic pump assemblies operating at 15 rpm and corresponding downhole fluid production metrics. The minimum four chamber peristaltic pump would produce 500 barrels of downhole fluid per day (B/D) if the peristaltic pump works at 15 rpm (revolutions per minutes) or spm (strokes per minute).

It is important to remark that values of production in FIGS. 8-9 may be based on an assumption that 78% of the cross-sectional area of the hose could be compressed on each chamber. In addition, with an estimated length of 130 feet, a reliable performance on highly deviated and horizontal wells may be expected. Higher rpm, e.g., 30, 60, could indicate more B/D.

In some versions, a downhole peristaltic pump may include five chambers for use with a single-acting quintuplex surface pump.

What is claimed as the invention is:

1. A peristaltic pump assembly for pumping wellbore fluid, comprising:

a pump;

a housing having a fluid port;

a conduit coupled to the pump and the housing, wherein hydraulic fluid is capable of ingress into the housing through the conduit and the fluid port;

a support disposed in the housing, wherein the support has an inner surface; and a hose having a hose portion disposed in the housing, and the hose portion has as an outer surface adjacent the inner surface of the support, wherein the hose portion is capable of being compressed by the ingress of hydraulic fluid from the conduit into the housing; and wherein the housing the hose portion pushes against the inner surface of the support when there is ingress of hydraulic fluid from the conduit into the housing and sufficient increase of fluid pressure in the housing to push the hose portion against the inner surface of the support.

2. The peristaltic pump assembly of claim 1, wherein the housing has an inner cylindrical surface and the support is separate from the housing and has an outer cylindrical surface that abuts against the inner cylindrical surface of the housing.

3. The peristaltic pump assembly of claim 1, wherein the support is rigid and cylindrical and has a semi-circular cross-section.

4. The peristaltic pump assembly of claim 1, wherein the housing has an outer surface and the support is unitary with the housing.

5. A peristaltic pump assembly for pumping wellbore fluid, comprising:

a pump;

a housing having an inner surface and a fluid port;

a conduit coupled to the pump and the housing, wherein hydraulic fluid is capable of ingress into the housing through the conduit and the fluid port; or egress from the housing through the conduit and the fluid port;

a hose having a hose portion disposed in the housing, wherein the hose portion includes a support and a collapsible section; wherein the support has an outer surface; and wherein the support pushes against the inner surface of the housing when there is ingress of hydraulic fluid from the conduit into the housing and sufficient increase of fluid pressure in the housing to push the support against the inner surface of the housing.

6. The peristaltic pump assembly of claim 5, wherein the hose portion and the support are unitary.

7. The peristaltic pump assembly of claim 5, wherein the support is abutted against the inner surface of the housing.

8. The peristaltic pump assembly of claim 5, wherein the wellbore fluid is capable of flowing through the hose portion disposed in the housing.

9. The peristaltic pump assembly of claim 5, wherein the support is disposed between the collapsible section and the housing.

10. A peristaltic pump assembly for pumping wellbore fluid, comprising:

a pump;

a housing;

a first chamber disposed in the housing;

a second chamber disposed in the housing;

a hose having a first hose portion disposed in the first chamber and a second hose portion disposed in the second chamber;

a first support disposed between the first portion of the hose and the housing, wherein the first support comprises:

a first outer cylindrical wall adjacent a first inner cylindrical wall of the housing; and a concave portion capable of receiving the first hose portion;

a second support disposed between the second portion of the hose and the housing, wherein the second support comprises:

a second outer cylindrical wall adjacent a second inner cylindrical wall of the housing; and a concave portion capable of receiving the second hose portion;

a first conduit coupled to the pump and the housing, the first conduit in fluid communication with first chamber; and a second conduit coupled to the pump and the housing, the second conduit in fluid communication with the second chamber; wherein:

the first hose portion is capable of being compressed by the ingress of hydraulic fluid from the first conduit into the first chamber and the second hose portion is capable of being compressed by the ingress of hydraulic fluid from the second conduit into the second chamber; wherein the first hose portion has as an outer surface adjacent an inner surface of the first support and the second hose portion has as an outer surface adjacent an inner surface of the second support; wherein the first hose portion pushes against the inner surface of the first support when there is ingress of hydraulic fluid from the first conduit into the first chamber and sufficient increase of fluid pressure in the first chamber to push the first hose portion against the inner surface of the first support; and the second hose portion pushes against the inner surface of the second support when there is ingress of hydraulic fluid from the second conduit into the second chamber and sufficient increase of fluid pressure in the second chamber to push the second hose portion against the inner surface of the second support.

11. The peristaltic pump assembly of claim 10, wherein fluid is capable of ingress into the first chamber from the first conduit or egress from the first chamber into the first conduit, or both.

12. The peristaltic pump assembly of claim 10, wherein fluid is capable of ingress into the second chamber from the second conduit or egress from the second chamber into the second conduit, or both.

13. The peristaltic pump assembly of claim 10, wherein the first portion of the hose and the first support are unitary.

14. The peristaltic pump assembly of claim 10, wherein the second portion of the hose and the second support are unitary.

15. The peristaltic pump assembly of claim 10, further comprising a coupler coupled to the first hose portion of the hose and the second hose portion of the hose.

16. The peristaltic pump assembly of claim 10, wherein collapse of the first hose portion of the hose pushes wellbore fluid from the first hose portion of the hose into the second hose portion of the hose.

17. The peristaltic pump assembly of claim 10, wherein the first hose portion of the hose is collapsible by fluid flowing from the first conduit.

18. The peristaltic pump assembly of claim 10, wherein the second hose portion of the hose is collapsible by fluid flowing from the second conduit.

* * * * *